US009719325B2

(12) United States Patent
Carder et al.

(10) Patent No.: US 9,719,325 B2
(45) Date of Patent: Aug. 1, 2017

(54) DOWNHOLE TOOL CONSISTENT FLUID CONTROL

(71) Applicant: Halliburton Energy Services, Inc., Houston, TX (US)

(72) Inventors: Charles Frederick Carder, Carrollton, TX (US); Paul David Ringgenberg, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/784,514

(22) PCT Filed: May 16, 2013

(86) PCT No.: PCT/US2013/041430

§ 371 (c)(1),
(2) Date: Oct. 14, 2015

(87) PCT Pub. No.: WO2014/185924

PCT Pub. Date: Nov. 20, 2014

(65) Prior Publication Data

US 2016/0053573 A1 Feb. 25, 2016

(51) Int. Cl.

| | |
|---|---|
| ***E21B 34/08*** | (2006.01) |
| ***E21B 34/16*** | (2006.01) |
| ***E21B 34/06*** | (2006.01) |
| ***E21B 43/12*** | (2006.01) |

(52) U.S. Cl.
CPC ..... *E21B 34/08* (2013.01); *E21B 34/066* (2013.01); *E21B 34/085* (2013.01); *E21B 34/16* (2013.01); *E21B 43/12* (2013.01)

(58) Field of Classification Search
CPC .. E21B 2034/002; E21B 49/001; E21B 17/07; E21B 17/073; E21B 2034/005; E21B 23/04; E21B 33/1295; E21B 34/103; E21B 34/108; E21B 49/088; F16F 13/305
See application file for complete search history.

(56) References Cited

U.S. PATENT DOCUMENTS

| | | | | |
|---|---|---|---|---|
| 2,661,596 | A * | 12/1953 | Winslow | C10M 171/001 192/21.5 |
| 3,354,950 | A | 11/1967 | Hyde | |
| 3,760,832 | A * | 9/1973 | McGowen, Jr. | E21B 34/066 137/155 |
| 3,850,250 | A | 11/1974 | Holden et al. | |
| 4,063,893 | A | 12/1977 | Stoulil et al. | |
| 4,064,937 | A | 12/1977 | Barrington | |
| 4,113,012 | A | 9/1978 | Evans et al. | |
| 4,328,866 | A | 5/1982 | Zimmerman | |

(Continued)

OTHER PUBLICATIONS

International Search Report, Jan. 29, 2014, 5 pages; Korean International Searching Authority.

*Primary Examiner* — James G Sayre
(74) *Attorney, Agent, or Firm* — Haynes and Boone LLP

(57) ABSTRACT

A downhole apparatus for use in a wellbore includes a housing having at least one passage or cavity capable of receiving a fluid. The downhole apparatus further includes an orifice in fluid communication with the passage or cavity. A viscosity-altering member is positioned in proximity to the orifice and is capable of being activated to change the viscosity of the fluid and thus a rate at which the fluid is able to pass through the orifice.

21 Claims, 7 Drawing Sheets

(56) References Cited

U.S. PATENT DOCUMENTS

| | | | | |
|---|---|---|---|---|
| 4,422,506 | A | 12/1983 | Beck | |
| 5,029,677 | A * | 7/1991 | Mitsui | F16C 27/045 188/267.1 |
| 5,277,281 | A | 1/1994 | Carlson et al. | |
| 5,452,745 | A * | 9/1995 | Kordonsky | F15B 21/065 137/807 |
| 5,683,615 | A | 11/1997 | Munoz | |
| 6,257,356 | B1 | 7/2001 | Wassell | |
| 6,527,661 | B2 | 3/2003 | Leeper | |
| 8,443,875 | B2 * | 5/2013 | Lee | E21B 10/322 166/66.5 |
| 2003/0192687 | A1 * | 10/2003 | Goodson, Jr. | E21B 23/04 166/65.1 |
| 2009/0272579 | A1 | 11/2009 | Sihler et al. | |
| 2010/0224410 | A1 * | 9/2010 | Wassell | E21B 17/073 175/40 |

* cited by examiner

DOWNHOLE TOOL CONSISTENT FLUID CONTROL

CROSS-REFERENCE TO RELATED APPLICATIONS

This application is a U.S. National Stage patent application of International Patent Application No. PCT/US2013/041430, filed on May 16, 2013, the benefit of which is claimed and the disclosure of which is incorporated herein by reference in its entirety.

BACKGROUND

1. Field of the Invention

The present disclosure relates generally to the recovery of subterranean deposits and more specifically to methods and systems for controlling fluid flow within a well.

2. Description of Related Art

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. The drill bit is attached to a drill string that may be rotated to drive the drill bit and within which drilling fluid, referred to as "drilling mud" or "mud", may be delivered downhole. The drilling mud is used to cool and lubricate the drill bit and downhole equipment and is also used to transport any rock fragments or other cuttings to the surface of the well.

During the drilling, testing, and subsequent production phases of a well, many downhole tools and systems are used that require control of fluids, whether internal to the tool or system, or external and circulating through the well. Attempts to control fluid flow downhole typically involve valves and other restrictive devices. When precise metering of fluid flow or pressures is required, flow restrictors such as the Visco Jet™ are sometimes used. While sometimes effective, these devices are often rendered inoperable or less effective due to debris that may be carried by the metered fluid and deposited within the flow path of these devices. These devices also may require costly sealing systems that may compromised by debris in the fluid.

SUMMARY

The problems presented by existing systems and methods for controlling fluid flow are solved by the systems and methods of the illustrative embodiments described herein. In one embodiment, a downhole tester valve for collecting a formation fluid for testing is provided. The downhole tester valve includes a housing and a valve member positioned within the housing and selectively positionable in an open position or a closed position to allow or prevent fluid communication through a passage of the downhole tester valve. The downhole tester valve further includes a liquid chamber positioned within the housing. The liquid chamber has a liquid with a selectively-adjustable viscosity, the liquid capable of directly or indirectly exerting a force on the valve member to move the valve member to at least one of the open position or the closed position. An orifice associated with the liquid chamber allows the liquid to enter or exit the liquid chamber. A viscosity-altering member is capable of being activated to change the viscosity of the liquid and thus a rate at which the liquid is able to enter or exit the orifice, thereby controlling the application of the force by the liquid.

In another embodiment, a method of operating a downhole device having a housing and at least one passage or cavity capable of receiving a fluid is provided. The downhole device further includes an orifice in fluid communication with the passage or cavity. A fluid having a viscosity of a first amount is flowed through the aperture of the downhole device. The viscosity of the fluid is selectively changed to a second amount such that a rate at which the fluid is able to enter or exit the orifice is changed.

In yet another embodiment, a downhole apparatus for use in a wellbore includes a housing having at least one passage or cavity capable of receiving a fluid. The downhole apparatus further includes an orifice in fluid communication with the passage or cavity. A viscosity-altering member is positioned in proximity to the orifice and is capable of being activated to change the viscosity of the fluid and thus a rate at which the fluid is able to pass through the orifice.

Other objects, features, and advantages of the invention will become apparent with reference to the drawings, detailed description, and claims that follow.

DETAILED DESCRIPTION OF ILLUSTRATIVE EMBODIMENTS

Figure 1:
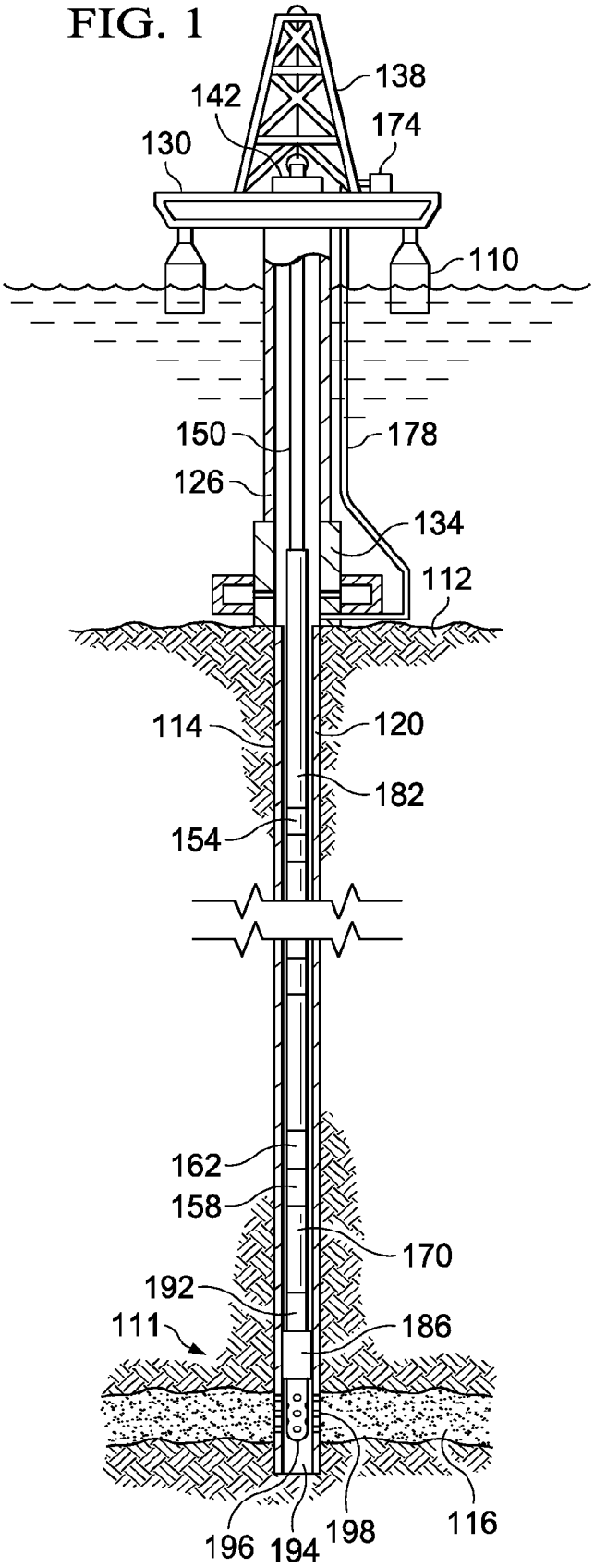
FIG. 1 illustrates a schematic depiction of a well in which a tester valve and a viscosity-altering member according to an illustrative embodiment are deployed.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention.

To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The systems and methods described herein provide control of fluids used in wells to recover subterranean deposits. More specifically, the systems and methods provide selective control of fluid flow rate or pressure drop. Such systems and methods are beneficial in the operation of downhole valves used to test formations, but may be equally or more beneficial in other downhole or surface-based devices and operations. In some of the embodiments described herein, a viscosity-altering source or member is used to alter the viscosity of a fluid, thereby altering the flow of the fluid through an orifice or fluid passage. The viscosity-altering member may be a magnetic field generator, and the fluid may be a magnetorheological fluid. Alternatively, the viscosity-altering member may be an electric field generator, and the fluid may be an electrorheological fluid. In these embodiments, the application of the magnetic field or the electric field, as the case may be, increases the apparent viscosity of the liquid within a very short period of time. The increase in apparent viscosity may in some circumstances result in the fluid becoming a viscoelastic solid, thereby preventing flow of the fluid exposed to the applicable field.

By selectively adjusting the apparent viscosity of fluids contained with downhole devices or surface-based devices, extreme flexibility is provided in the ability to control the flow of the fluids. This in turn allows manipulation and control of devices where valves or other metering devices might normally be used.

Some of the illustrative embodiments described in the following disclosure, such as the tester valve in which a viscosity-altering member resides, may be used to evaluate a formation through which a well passes. Tester valves, or other downhole devices that incorporate the flow control devices described herein may be used with any of the various techniques employed for drilling, testing or otherwise evaluating formations including, without limitation, wireline formation testing (WFT), measurement while drilling (MWD), and logging while drilling (LWD). The various valves and tools described herein may be delivered downhole as part of a wireline-delivered downhole assembly or as a part of a drill string.

As used herein, the phrases "fluidly coupled," "fluidly connected," and "in fluid communication" refer to a form of coupling, connection, or communication related to fluids, and the corresponding flows or pressures associated with these fluids. Reference to a fluid coupling, connection, or communication between two components describes components that are associated in such a way that a fluid can flow between or among the components.

Referring to FIG. 1, a floating platform 110 is positioned over a submerged oil or gas well 111 located in the sea floor 112 having a bore hole 114 which extends from the sea floor 112 to a submerged formation 116 to be tested. The bore hole 114 may be lined by a casing 120 cemented into place. A subsea conduit 126 extends from a deck 130 of the floating platform 110 into a wellhead installation 134. The floating platform 110 further includes a derrick 138 and a hoisting apparatus 142 for raising and lowering tools to drill, test, and complete the oil or gas well 111.

A testing string 150 is lowered into the bore hole 114 of the oil or gas well 111. The testing string 150 includes such tools as a slip joint 154 to compensate for the wave action of the floating platform 110 as the testing string 150 is lowered into place, a tester valve 158 and a circulation valve 162.

The slip joint 154 may be similar to that described in U.S. Pat. No. 3,354,950 to Hyde. The circulation valve 162 may be an annulus pressure responsive type and may be similar to that described in U.S. Pat. No. 3,850,250 to Holden et al, or may be a combination circulation valve and sample entrapment mechanism similar to those disclosed in U.S. Pat. No. 4,063,593 to Jessup or U.S. Pat. No. 4,064,937 to Barrington. The circulation valve 162 may also be the re-closable type as described in U.S. Pat. No. 4,113,012 to Evans et al.

A check valve assembly 170 as described in U.S. Pat. No. 128,324 filed Mar. 7, 1980 which is annulus pressure responsive may be located in the testing string below the tester valve 158 of the present invention.

The tester valve 158, circulation valve 162 and check valve assembly 170 may be operated by fluid annulus pressure exerted by a pump 174 on the deck 130 of the floating platform 110. Pressure changes are transmitted by a pipe 178 to a well annulus 182 between the casing 120 and the testing string 150. Well annulus pressure is isolated from the formation 116 to be tested by a packer 186 set in the well casing 120 just above the formation 116. The packer 186 may be any suitable packer, such as for example a Baker Oil Tool™ Model D packer, an Otis™ type W packer or the Halliburton Services EZ Drill® SV packer.

The testing string 150 includes a tubing seal assembly 192 at the lower end of the testing string which stabs through a passageway through the production packer 186 for forming a seal isolating the well annulus 182 above the packer 186 from an interior bore portion 194 of the well immediately adjacent the formation 116 and below the packer 186.

A perforated tail piece 196 or other production tube is located at the bottom end of the seal assembly 192 to allow formation fluids to flow from the formation 116 into the flow passage of the testing string 150. Formation fluid is admitted into interior bore portion 194 through perforations 198 provided in the casing 120 adjacent formation 116.

A formation test controlling the flow of fluid from the formation 116 through the flow channel in the testing string 150 by applying and releasing fluid annulus pressure to the well annulus 182 by pump 174 to operate tester valve 158, circulation valve assembly 162 and check valve assembly 170 and measuring of the pressure build-up curves and fluid temperature curves with appropriate pressure and temperature sensors in the testing string 150 is described in more detail in the aforementioned patents and patent application, all of which are incorporated herein by reference.

While the well 111 is illustrated as being an offshore well in FIG. 1, the systems and devices described herein will function equally well in an on-shore well.

Figure 2:
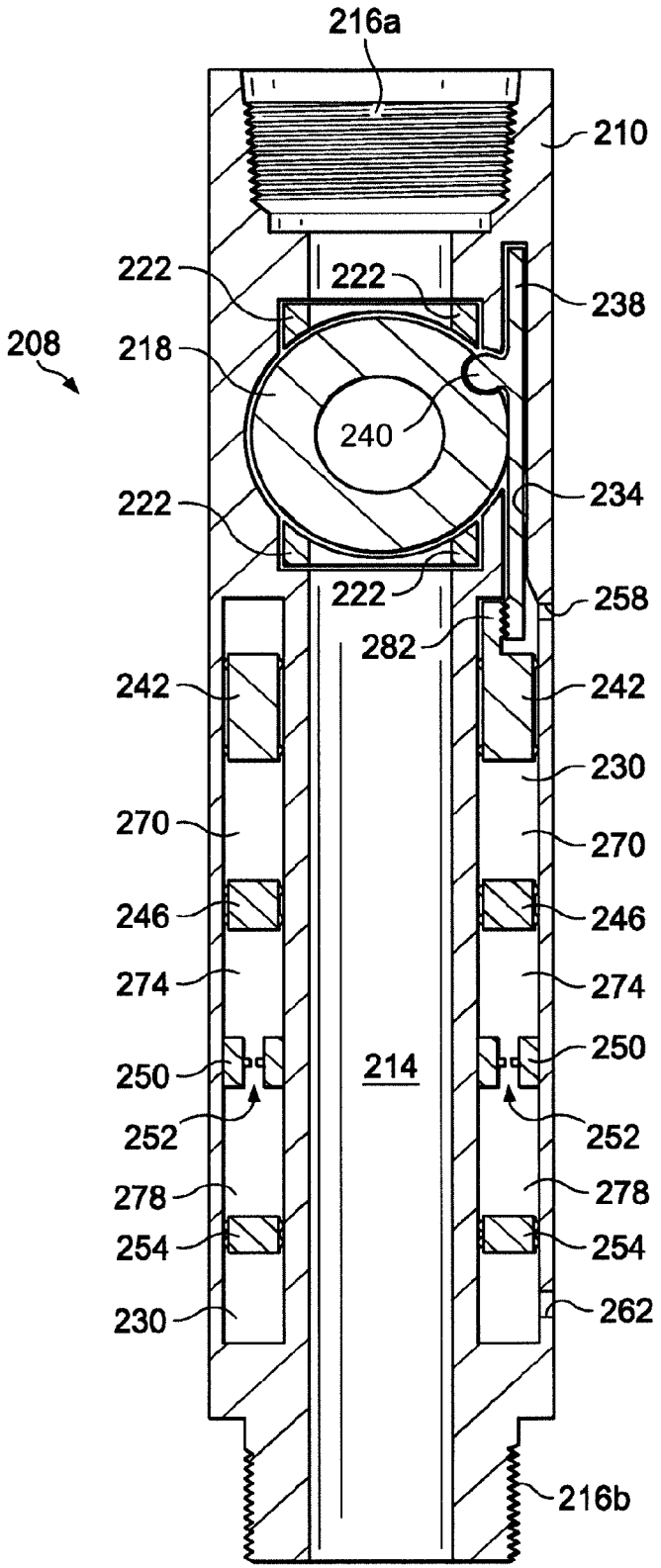
FIG. 2 illustrates a cross-sectional front view of the tester valve and viscosity-altering member of FIG. 1.

Referring to FIG. 2, a tester valve 208 according to an illustrative embodiment is similar to tester valve 158 and is similar in function to the tester valve described in U.S. Pat. No. 4,422,506, which is hereby incorporated by reference. Tester valve 208 is depicted schematically in FIG. 2 and includes a valve housing 210 that is substantially cylindrical in shape and includes a central passage 214 extending the length of the valve housing 210. The valve housing 210 includes threaded connection components 216*a*, 216*b* to allow connection of the tester valve 208 within a test string or to other downhole devices. A valve member 218 is rotatably positioned within the valve housing 210 and is axially anchored within the valve housing 210 by ring-shaped valve seats 222 positioned above and below the valve member 218. The valve housing 210 includes an annular chamber 230 and an actuation sleeve 234 extending from the annular chamber. The actuation sleeve 234 receives an actuation arm 238 having a spherically shaped lug 240 that is received by a complimentary recess on the valve member 218. Through movement of the actuation arm 238 in a direction parallel to the longitudinal axis of the valve housing 210, the valve member 218 is positioned in a closed position (shown in FIG. 2) that prevents fluid flow past the valve member 218 or in an open position that allows fluid flow past the valve member 218.

Positioned within the annular chamber 230 are a power mandrel 242, a gas-fluid balancing seal 246, a viscosity-altering member 250, and a fluid balancing piston 254. An upper port 258 provides fluid communication between an exterior of the valve housing 210 and the annular chamber 230 above the power mandrel 242. A lower port 262 provides fluid communication between the exterior of the valve housing 210 and the annular chamber 230 beneath the fluid balancing piston 254. Between the power mandrel 242 and the gas-fluid balancing seal 246 is a gas-filled region 270 of the annular chamber 230. Seals on both the power mandrel and the gas-fluid balancing seal 246 prevent leakage of gas from the gas-filled region 270. The gas that is provided in the gas-filled region 270 may be an inert gas, and in one embodiment, the gas may be nitrogen. Between the gas-fluid balancing seal 246 and the fluid balancing piston 254 are an upper liquid region 274 and a lower liquid region 278, the two regions separated by the viscosity-altering member 250 and an orifice 252. Each of the upper liquid region 274 and the lower liquid regions 278 are filled with a liquid, which in some embodiments may be a magneto-rheological fluid (MR fluid). The MR fluid is a fluid that experiences an increase in apparent viscosity when subjected to a magnetic field. Typically, the MR fluid is an oil, but the fluid could be any type that demonstrates these characteristics. The MR fluid typically includes magnetic particles, which are micrometer or nanometer scale particles (often spheres or ellipsoids) that are suspended within the fluid and distributed randomly when the fluid is not exposed to a magnetic field. In the presence of a magnetic field, the magnetic particles align along lines of magnetic flux, which results in an increase in the apparent viscosity of the fluid.

In other embodiments, the fluid contained in the upper liquid region 274 and the lower liquid region 278 may be an electrorheological fluid (ER fluid). The ER fluid includes suspensions of extremely fine non-conducting particles (up to 50 micrometers diameter) in an electrically insulating fluid. The apparent viscosity of these fluids changes reversibly by an order of up to 100,000 in response to an electric field. For example, a typical ER fluid can go from the consistency of a liquid to that of a gel, and back, with response times on the order of milliseconds. There are two main theories to explain the operation of an ER fluid: the interfacial tension theory and the electrostatic theory. The interfacial tension theory assumes a three phase system—the particles contain the third phase which is another liquid (e.g. water) immiscible with the main phase liquid (e.g. oil). When no electric field is applied, the third phase is strongly attracted to and held within the particles. The ER fluid at this stage is a suspension of particles, which behaves as a liquid. When an electric field is applied, the third phase is driven to one side of the particles by electro osmosis and binds adjacent particles together to form chains. This chain structure results in the ER fluid becoming a solid. The electrostatic theory assumes a two phase system, with dielectric particles forming chains aligned with an electric field in an analogous way to how the MR fluid works. Under this theory, the ER fluid is constructed with the solid phase made from a conductor coated in an insulator.

The particles in the ER fluid are electrically active. The particles may be ferroelectric or, as mentioned above, made from a conducting material coated with an insulator, or electro-osmotically active particles. In the case of ferroelectric or conducting material, the particles would have a relatively high dielectric constant.

The power mandrel 242 is ring-shaped and is positioned in annular chamber 230 such that it is capable of axial movement. An extension member 282 extends from the power mandrel 242 and is connected to the actuation arm 238 so that the actuation arm 238 moves along with the power mandrel 242. The nitrogen or other gas in the gas-filled region 270 serves dual purposes. First, the gas is capable of cushioning the movement of the power mandrel 242, and thus the valve member 218 when an operator decides to move the valve member 218 to the open position. Second, and as explained in more detail below, the pressurized gas within the gas-filled region 270 assists in moving the valve member 218 to a closed position when directed by the operator. Prior to deploying the tester valve 208 downhole, the gas-filled region 270 is filled with gas until a desired pressure is reached. Since low temperatures may be encountered downhole, the pressure of gas within the gas-filled region 270 may decrease if subjected to severe temperature drops. Since the operation of the valve member 218 depends greatly on the pressure of gas within the gas-filled region 270, it is important that the pressure of gas remain relatively close to but slightly less than the pressure of the fluid surrounding the tester valve 218, i.e. the annulus pressure. This pressure compensation is made possible by the presence of the lower port 262, the fluid balancing piston 254, the upper and lower liquid regions 274, 278, the viscosity-altering member 250, and the gas-fluid balancing seal 246. The pressure of fluid surrounding the tester valve 208 is communicated through the lower port 262 into the area of the annular chamber 230 beneath the fluid balancing piston 254. The fluid balancing piston 254 moves axially in response to the pressure (upward movement if higher pressure is encountered, downward movement if lower pressure is encountered). The movement of the fluid balancing piston 254 results in a pressure change of the liquid in the lower liquid region 278, and in the scenario where the pressure of the liquid in the lower liquid region 278 increases, liquid is compelled to move through the orifice 252 associated with the viscosity-altering member 250 toward the upper liquid region 274 until equilibrium is reached. The viscosity-altering member 250 is capable of metering flow of fluid through the orifice 252 by altering the apparent viscosity of the fluid. When the fluid is an MR fluid, the viscosity-altering member 250 may be a magnetic source that is capable of exposing the fluid near or passing through the orifice 252 to a magnetic field. When the fluid is an ER fluid, the viscosity-altering member 250 may be electrodes or another electric energy source that is capable of exposing the fluid near or passing through the orifice 252 to an electric field. As the fluid near or within the orifice 252 is exposed to the magnetic or electric field, as the case may be, the apparent viscosity of the fluid increases, thereby slowing the rate of flow through the orifice 252 and increasing the pressure differential across the orifice 252. This change in the fluid allows the flow through the orifice to essentially be metered and controlled based upon the strength of the magnetic or electric field.

As liquid passes through the orifice 252 and the pressure of liquid in the upper liquid region 274 rises, this pressure is transmitted to the gas-filled region 270 by the movement of gas-fluid balancing seal 246.

To open the valve member 218, the annulus pressure surrounding the tester valve 208 is increased, which is communicated through upper port 258 and exerts a downward force on the power mandrel 242. The power mandrel 242 therefore moves axially downward, pulling the actuation arm 238, which positions the valve member 218 in the open position. Since the pressure of gas in the gas-filled region 270 closely approximates the annulus pressure surrounding the tester valve 208, the gas-filled region 270 is capable of cushioning the downward movement of the power mandrel 242 and thus the opening of the valve member 218.

The force imparted to the power mandrel 242 is still able to overcome any force exerted by the gas-filled region 270 since the increases to the annulus pressure are communicated through the lower port 262 and are modulated by the presence and flow metering capabilities of the viscosity-altering member 250. It should be noted, however, that the increase in annulus pressure, which is used to open the valve member 218, is transmitted as a corresponding pressure increase to the gas-filled region 270 through the lower port 262 and the components previously described. Due to the presence of the viscosity-altering member 250, the subsequent increase in pressure in the gas-filled region 270 is not as great as the annulus pressure increase, thereby resulting in the imbalance in forces across the power mandrel 242 that allow the power mandrel to move downward.

When it is desired to close the valve member 218, the annulus pressure surrounding the tester valve 208 is decreased. Although the pressure decrease is communicated through both the upper and lower ports 258, 262, the metering of fluid flow through the viscosity-altering member 250 creates a lag in the time it takes for the gas-filled region to decrease in pressure. Again, this creates an imbalance in forces across the power mandrel 242, with the pressure in the gas-filled region 270 beneath the power mandrel 242 begin greater than pressure in the annular chamber 230 above the power mandrel. This pressure differential moves the power mandrel 242 and actuation arm 238 upward, which returns the valve member 218 to the closed position.

Figure 3:
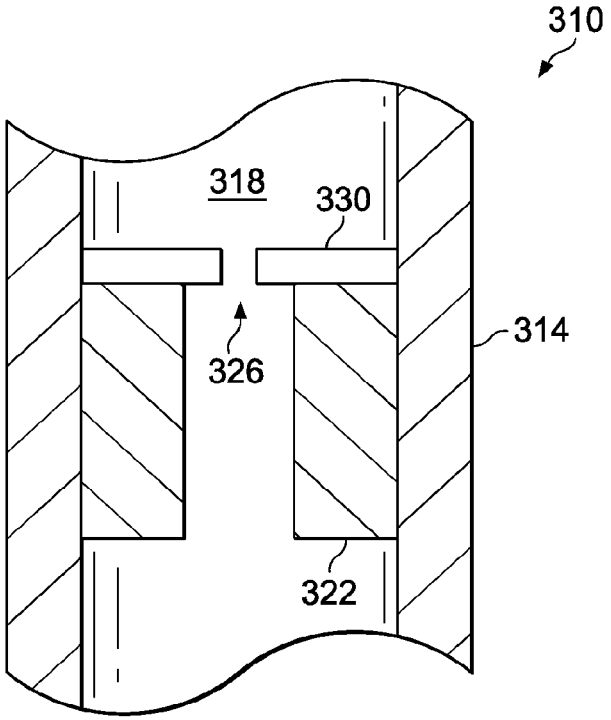
FIG. 3 illustrates a cross-sectional schematic of a flow control system according to an illustrative embodiment, the flow control system having a viscosity-altering member.

A viscosity-altering member similar to viscosity-altering member 250 associated with tester valve 208 may be used with many downhole devices or systems to control various aspects of fluid control within, through, or around those devices and systems. Referring to FIGS. 3-9, multiple configurations of viscosity-altering members are schematically illustrated to demonstrate various embodiments in which the viscosity-altering members may be used. Referring more specifically to FIG. 3, a flow control system 310 according to an illustrative embodiment includes a tubing string 314, which may be representative of a housing of a downhole device, a pipe, a tube, or any other conduit that may include a cavity or passage 318 within which a fluid may flow or be stored. It should be noted that the manner in which the tubing string is used in the downhole environment is not necessarily limited, but could be used in many downhole operations including, for example, drilling, testing, or production. Within the passage 318 and adjacent an inner surface of the tubing string 314, a viscosity-altering member 322 may be disposed. The viscosity-altering member 322 may be ring-shaped and extend circumferentially around the inner surface of the tubing string as illustrated in FIG. 3. In other embodiments, the viscosity-altering member 322 may be other suitable shapes or configurations to allow suitable delivery of a magnetic or electric field. For example, in some embodiments using an electric energy source as the viscosity-altering member 322, it may be desirable for the viscosity-altering member 322 to include one or more elongated electrodes that extend into or are otherwise positioned within the passage 318.

In the embodiment illustrated in FIG. 3, the flow control system 310 further includes an orifice 326 or aperture disposed within a plate 330 or ring positioned at an end of the viscosity-altering member 322. The plate 330 may be positioned at either end of the viscosity-altering member 322. In some embodiments, a separate plate may not be used to form the orifice. Instead, the orifice may simply be comprised of the passage through the ring-shaped viscosity-altering member 322.

Figure 4:
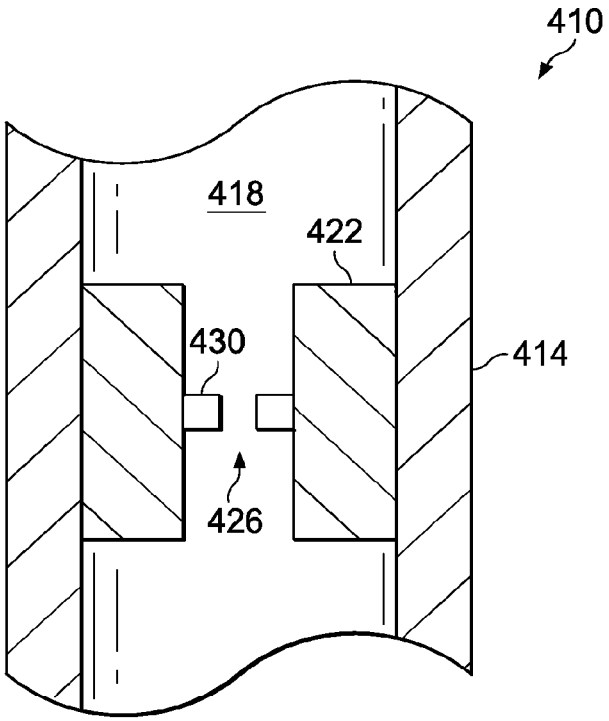
FIG. 4 illustrates a cross-sectional schematic of a flow control system according to an illustrative embodiment, the flow control system having a viscosity-altering member.

Referring to FIG. 4, a flow control system 410 according to an illustrative embodiment includes a tubing string 414, which may be representative of a housing of a downhole device, a pipe, a tube, or any other conduit that may include a cavity or passage 418 within which a fluid may flow or be stored. The manner in which the tubing string is used in the downhole environment is not necessarily limited, but could be used in many downhole operations including, for example, drilling, testing, or production. Within the passage 418 and adjacent an inner surface of the tubing string 414, a viscosity-altering member 422 may be disposed. The viscosity-altering member 422 may be ring-shaped and extend circumferentially around the inner surface of the tubing string as illustrated in FIG. 4. In other embodiments, the viscosity-altering member 422 may be other suitable shapes or configurations to allow suitable delivery of a magnetic or electric field. For example, in some embodiments using an electric energy source as the viscosity-altering member 422, it may be desirable for the viscosity-altering member 422 to include one or more elongated electrodes that extend into or are otherwise positioned within the passage 418.

In FIG. 4, the flow control system 410 further includes an orifice 426 or aperture disposed within a plate 430 or ring centrally positioned within a passage of the ring-shaped viscosity-altering member 422. While the orifice 426 in FIG. 4 is illustrated as being concentrically aligned with the passage of the ring-shaped viscosity-altering member 422 and also the passage 418, in some embodiments it may be desirable for the alignment of these features to be non-concentric.

Figure 5:
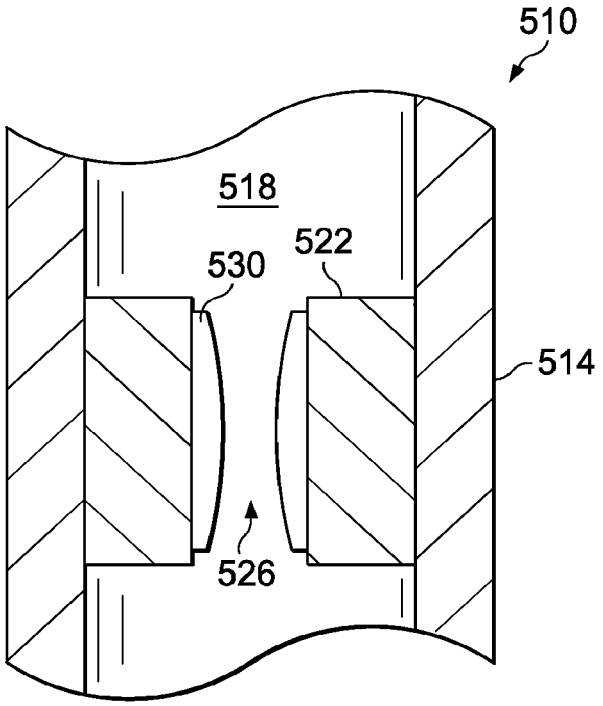
FIG. 5 illustrates a cross-sectional schematic of a flow control system according to an illustrative embodiment, the flow control system having a viscosity-altering member.

Referring to FIG. 5, a flow control system 510 according to an illustrative embodiment includes a tubing string 514, which may be representative of a housing of a downhole device, a pipe, a tube, or any other conduit that may include a cavity or passage 518 within which a fluid may flow or be stored. The manner in which the tubing string is used in the downhole environment is not necessarily limited, but could be used in many downhole operations including, for example, drilling, testing, or production. Within the passage 518 and adjacent an inner surface of the tubing string 514, a viscosity-altering member 522 may be disposed. The viscosity-altering member 522 may be ring-shaped and extend circumferentially around the inner surface of the tubing string as illustrated in FIG. 5. In other embodiments, the viscosity-altering member 522 may be other suitable shapes or configurations to allow suitable delivery of a magnetic or electric field. For example, in some embodiments using an electric energy source as the viscosity-altering member 522, it may be desirable for the viscosity-altering member 522 to include one or more elongated electrodes that extend into or are otherwise positioned within the passage 518.

In FIG. 5, the flow control system 510 further includes an orifice 526 or aperture formed within an insert 530 or ring positioned within a passage of the ring-shaped viscosity-altering member 522. While the orifice 526 in FIG. 5 is illustrated as being concentrically aligned with the passage of the ring-shaped viscosity-altering member 522 and also the passage 518, in some embodiments it may be desirable for the alignment of these features to be non-concentric. The orifice 526 differs from orifices 326, 426 in that orifice 526 includes a sloped transition region on either end of the narrowest part of the insert 530. This type of graduated orifice 526 may provide additional fluid control characteristics that are desired when used with the viscosity-altering member 522.

Figure 6:
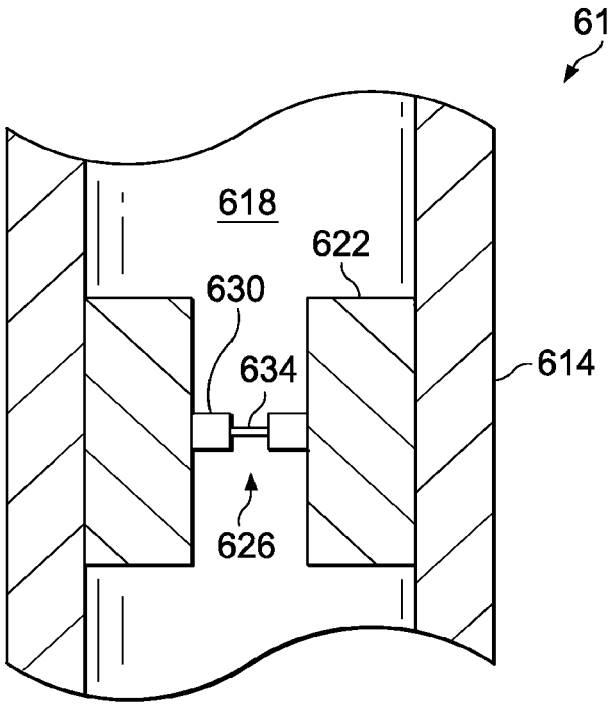
FIG. 6 illustrates a cross-sectional schematic of a flow control system according to an illustrative embodiment, the flow control system having a viscosity-altering member.

Referring to FIG. 6, a flow control system 610 according to an illustrative embodiment includes a tubing string 614, which may be representative of a housing of a downhole device, a pipe, a tube, or any other conduit that may include a cavity or passage 618 within which a fluid may flow or be stored. The manner in which the tubing string is used in the downhole environment is not necessarily limited, but could be used in many downhole operations including, for example, drilling, testing, or production. Within the passage 618 and adjacent an inner surface of the tubing string 614, a viscosity-altering member 622 may be disposed. The viscosity-altering member 622 may be ring-shaped and extend circumferentially around the inner surface of the tubing string as illustrated in FIG. 6. In other embodiments, the viscosity-altering member 622 may be other suitable shapes or configurations to allow suitable delivery of a magnetic or electric field. For example, in some embodiments using an electric energy source as the viscosity-altering member 622, it may be desirable for the viscosity-altering member 622 to include one or more elongated electrodes that extend into or are otherwise positioned within the passage 618.

In FIG. 6, the flow control system 610 further includes an orifice 626 or aperture disposed within a plate 630 or ring centrally positioned within a passage of the ring-shaped viscosity-altering member 622. While the orifice 626 in FIG. 6 is illustrated as being concentrically aligned with the passage of the ring-shaped viscosity-altering member 622 and also the passage 618, in some embodiments it may be desirable for the alignment of these features to be non-concentric. Within the orifice 626 of flow control system 610 is positioned a screen 634 or other flow restriction. The screen 634 may serve to further restrict or prevent flow of fluid through the orifice 626 when the apparent viscosity of the fluid is increased.

Each of the embodiments illustrated in FIGS. 3-6 allow selective control of fluid flow within the passage without the drawbacks of a conventional valve or a restriction device such as the Visco Jet™ manufactured by The Lee Company™ of Westbrook, Conn. Both of these traditional devices can be relatively intolerant of debris within the fluid, which tends to clog the devices. By using the viscosity-altering member in conjunction with an orifice or passage and an MR fluid or ER fluid, the flow of the fluid may be quickly and precisely controlled. With such a configuration, it is possible to slow the flow through the orifice by increasing the apparent viscosity of the fluid, increase the flow through the orifice by decreasing the apparent viscosity of the fluid, or substantially prevent flow through the orifice by increasing the apparent viscosity to such a level that the fluid effectively becomes a non-flowing gel or solid.

The embodiments illustrated in FIGS. 3-6 may be particularly useful in downhole systems or devices where it is desired to selectively restrict fluid flow. For example, in devices that traditionally include two flow paths (one restricted and one unrestricted) for use at different times, the systems illustrated in FIGS. 3-6 would allow the use of a single flow path that may be selectively restricted. One particular tool that requires no restriction when fluid is flowing in one direction and restriction when fluid flows in the opposite direction is a single-phase downhole sampling tool such as the Armada® Sampling System manufactured by Halliburton Energy Services, Inc. of Houston, Tex. In a one-time-use tool such as the Armada® Sampling System, it may be desirable to link the activation of the electronics required to actuate the viscosity-altering member to a mechanical part such as a piston or other internal part that moves when it is desired to create a flow restriction with a passageway. Upon movement of the piston or other part, the viscosity-altering member would be activated, which would in turn restrict fluid flow within the passage. In other tools where it is desired to activate, de-activate, and re-activate the viscosity-altering member, there are multiple ways of triggering the electronics to actuate the viscosity-altering member. Examples of suitable triggers may include annulus pressure actuation, telemetry actuation, timber actuation, or an external fluid flow actuation. An example of such a re-activatable tool is a combination tester and circulating valve such as the ProPhase™ Well Test Valve manufactured by Halliburton Energy Services, Inc. of Houston, Tex. The traditional configuration of this valve uses a motor mechanical valving to vary fluid flow down different flow paths. This requires a relatively expensive motor and extremely clean fluid to maintain adequate sealing at each metal-to-metal face seal. As described herein, the viscosity-altering member may be used in place of the motor and complex valving system.

Still another tool in which the flow control systems of FIGS. 3-6 may be used is a jar tool used to dislodge stuck tools. An example of this type of tool is the Big John® Hydraulic Jar manufactured by Halliburton Energy Services, Inc. of Houston, Tex. In a hydraulic jar, the workstring is stretched by pulling the workstring, thereby creating tension in the hydraulic jar. A hydraulic time-delay system allows the tension within the hydraulic jar to quickly release, which delivers an upward impact to the stuck tool to dislodge the tool. The viscosity-altering members described herein may be used in a hydraulic jar to restrict and meter the fluid. When it is desired to release tension within the hydraulic jar, the viscosity-altering member may be de-activated, thereby allowing free flow of fluid within the jar and generating the desired jarring effect.

While it has been described herein embodiments in which the viscosity-altering member is activated using mechanical or hydraulic means, other methods of actuating the viscosity-altering member are possible, including pneumatic activation or electrical or optical activation conveyed from control or processing units disposed downhole or at the surface of the well. It may be desired in some embodiments to link the actuation of the viscosity-altering member to certain downhole parameters such as, for example, the temperature of the fluid for which flow is being controlled. Temperature sensors may be included in any of the embodiments described herein and may be integrated into the viscosity-altering member, positioned adjacent the viscosity-altering member, positioned within or on the tubing string, or otherwise positioned within the passage through which the fluid is permitted to flow. For some tools, it may be particularly advantageous to link the activation and operation of the viscosity-altering member to the fluid temperature. Typically, as a fluid's temperature increases, the viscosity of the fluid decreases. In tools such as the hydraulic jar, it is preferred that the timing of the jar be the same at ambient temperature as it is at downhole temperature (e.g., 400° F.). By linking the temperature sensor and related control electronics to the viscosity-altering member, as the temperature of the fluid rises, the viscosity-altering member may be actuated as required to keep the apparent viscosity of the fluid unchanged over its viscosity at ambient temperature.

Figure 7:
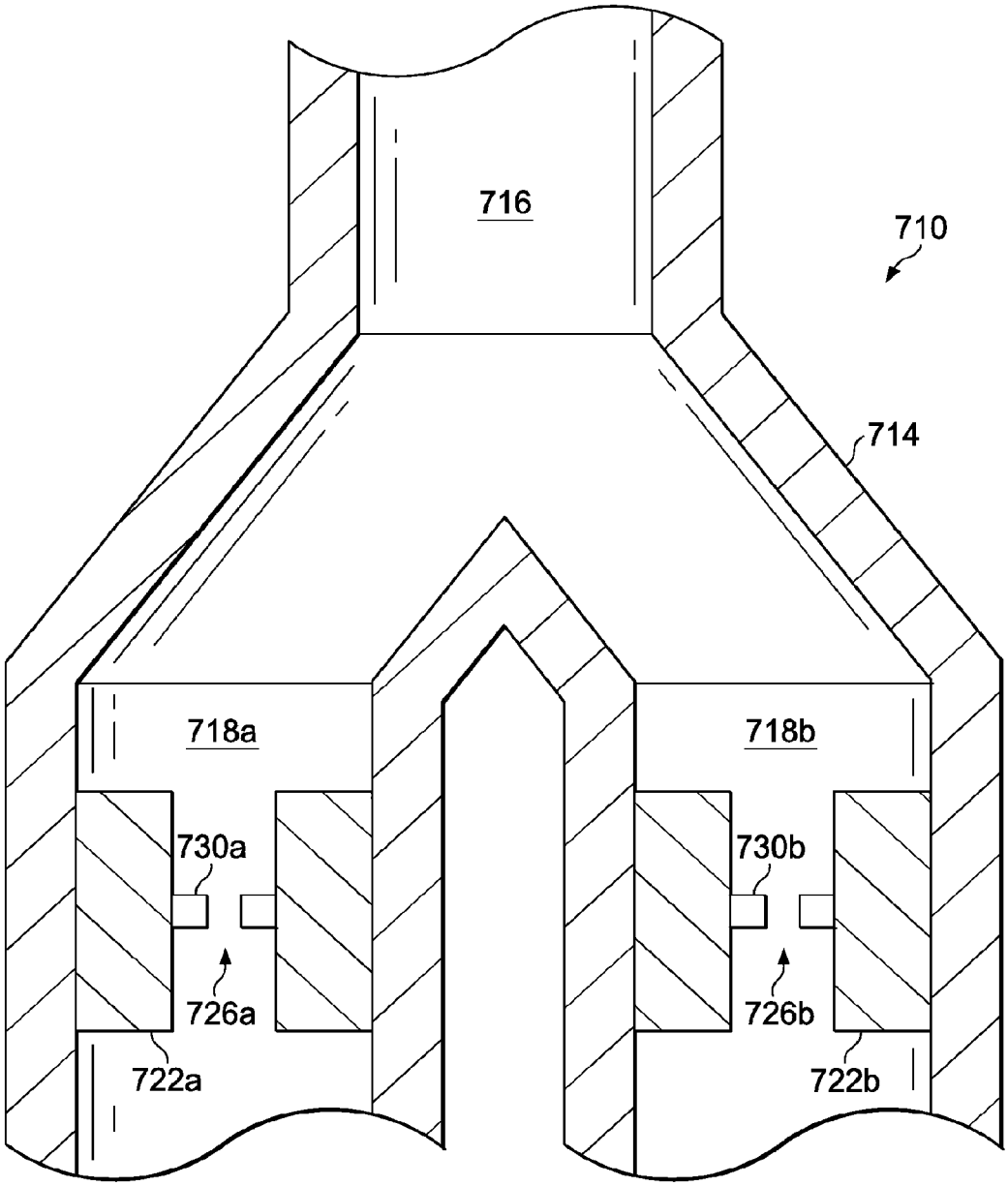
FIG. 7 illustrates a cross-sectional schematic of a flow control system according to an illustrative embodiment, the flow control system having a viscosity-altering member in each of two passages.

Referring to FIG. 7, a flow control system 710 according to an illustrative embodiment includes a tubing string 714, which may be representative of a housing of a downhole device, a pipe, a tube, or any other conduit that may include a cavity or passage 716 that diverges into two or more passages 718*a*, 718*b*, any of which allowing a fluid to flow or be stored. The manner in which the tubing string is used in the downhole environment is not necessarily limited, but could be used in many downhole operations including, for example, drilling, testing, or production. Within each of the passages 718*a*, 718*b* and adjacent an inner surface of the tubing string 714, a viscosity-altering member 722*a*, 722*b* may be disposed. The viscosity-altering members 722*a*, 722*b* may be ring-shaped and extend circumferentially around the inner surface of the tubing string as illustrated in FIG. 7. In other embodiments, the viscosity-altering members 722*a*, 722*b* may be other suitable shapes or configurations to allow suitable delivery of a magnetic or electric field. For example, in some embodiments using an electric energy source as the viscosity-altering member 722*a*, 722*b*, it may be desirable for one or more of the viscosity-altering members 722*a*, 722*b* to include one or more elongated electrodes that extend into or are otherwise positioned within the passages 718*a*, 718*b*.

In FIG. 7, the flow control system 710 further includes an orifice 726*a*, 726*b* or aperture disposed within a plate 730*a*, 730*b* or ring, each plate 730*a*, 730*b* being centrally positioned within a passage of the ring-shaped viscosity-altering members 722*a*, 722*b*. While the orifices 726*a*, 726*b* in FIG. 7 are illustrated as being concentrically aligned with the passages of the ring-shaped viscosity-altering members 722*a*, 722*b* and also the passages 718*a*, 718*b*, in some embodiments it may be desirable for the alignment of these features to be non-concentric.

The presence of independent viscosity-altering members 722*a*, 722*b* in each of the passages 718*a*, 718*b* allows independent control of fluid flow through each of the passages 718*a*, 718*b*. For example, to divert fluid flowing within passage 716 into solely passage 718*b*, the viscosity-altering member 722*a* in passage 718*a* may be actuated to increase the apparent viscosity of the near the viscosity-altering member 722*a* or the orifice 726*a* to such an extent that flow through the orifice 726*a* is substantially reduced or prevented. This actuation of the viscosity-altering member 722*a* may act as a valve to prevent flow through the passage 718*a*, thereby diverting flow into passage 718*b*. Alternatively, the viscosity-altering member 722*b* may be actuated to prevent or substantially reduced fluid flow through orifice 726*b* (and thus passage 718*b*), thereby diverting fluid flow into passage 718*a*. In some embodiments, it may be desirable to actuate both viscosity-altering members 722*a*, 722*b* at the same time to cease flow through passage 716, or in the circumstance where the flow through each orifice 726*a*, 726*b* is only reduced and not prevented, to modulate or meter the flow through each passage 718*a*, 718*b*.

An alternative configuration to that illustrated in FIG. 7, would be the same multiple passage tubing string 714 that includes a viscosity-altering member in only one of the passages. For example, the viscosity-altering member 722*a* may be positioned in passage 722*a* as previously described and no viscosity-altering member positioned within passage 718*b*.

Configurations similar to those illustrated in FIG. 7 may be particularly useful in a downhole system or tool in which a first flow path is needed at one point in time, and then at a second point in time, it is desired to restrict the first flow path to divert fluid to a different path or region of the tool or system. For example, a tool may be provided that is selectively responsive to either annulus pressure or to an internal tubing pressure. The tool may be configured such that passage 718*a* is fluidly connected to the annulus and passage 718*b* is fluidly connected to an interior of a tubing string. By selectively activating or deactivating the viscosity-altering members 722*a*, 722*b*, selective control over fluid communication with either the annulus or the interior of the tubing string (or both) may be accomplished.

The viscosity-altering members, plates (or rings), and screens described herein may be constructed from various materials depending on the degree to which it may be desired to adjust the viscosity of a particular fluid. In some embodiments, it may be desired to form some or all of the components from stainless steel, Inconel 718, or another non-magnetic material if it is desired simply to increase viscosity to slow the flow of the fluid. In other embodiments, it may be desired to form some or all of the components from a steel or other material, such as for example Mu-Metal or Permalloy, that would assist in directing the magnetic flux and would create a strong magnetic field around any orifice through which the fluid might pass (such as holes in the screen). In these particular embodiments, the stronger magnetic field may be used to completely block passage of fluid through the orifice.

Figure 8:
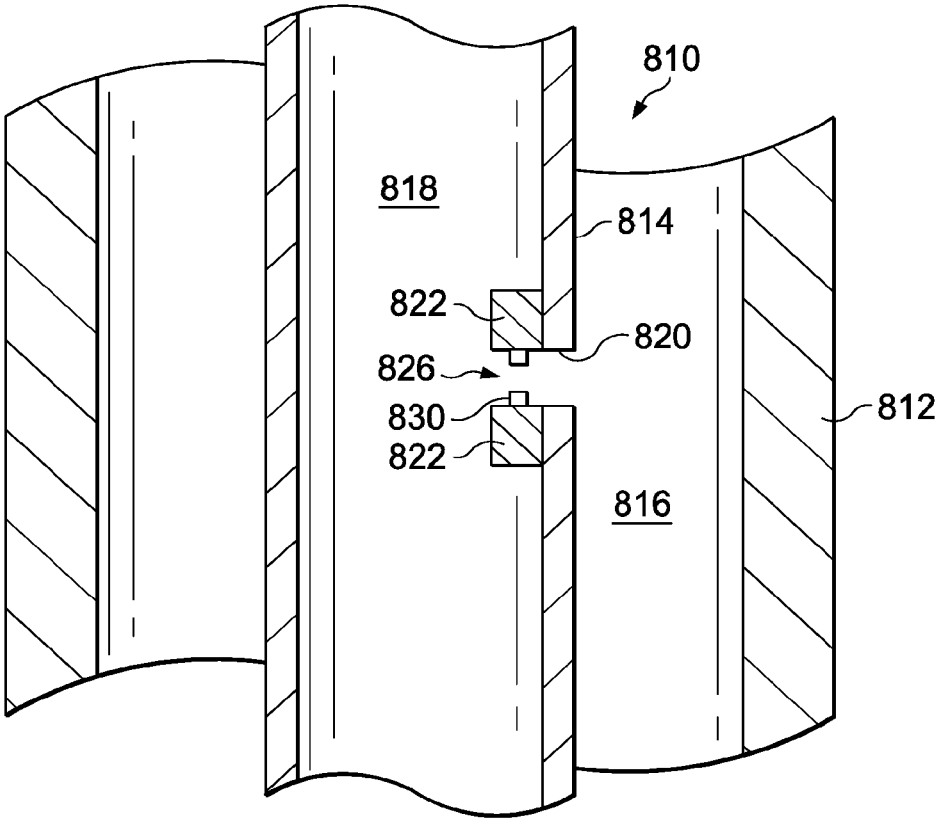
FIG. 8 illustrates a cross-sectional schematic of a flow control system according to an illustrative embodiment, the flow control system having a viscosity-altering member positioned adjacent a port in a tubing string.

Referring to FIG. 8, a flow control system 810 according to an illustrative embodiment includes a tubing string 814, which may be representative of a housing of a downhole device, a pipe, a tube, or any other conduit that may include a cavity or passage 818 within which a fluid may flow or be stored. The manner in which the tubing string is used in the downhole environment is not necessarily limited, but could be used in many downhole operations including, for example, drilling, testing, or production. In the embodiment illustrated in FIG. 8, the tubing string 814 is positioned within a wellbore having a casing 812 such than an annulus 816 is formed between the tubing string 814 and the casing.

The tubing string 814 includes a port 820. Within the passage 818 of the tubing string 814 and adjacent an inner surface of the tubing string 814, a viscosity-altering member 822 may be disposed such that is positioned adjacent the port 820. The viscosity-altering member 822 may be ring-shaped and extend around the port 820. In other embodiments, the viscosity-altering member 822 may be other suitable shapes or configurations to allow suitable delivery of a magnetic or electric field to fluid entering or exiting the port 820. For example, in some embodiments using an electric energy source as the viscosity-altering member 822, it may be desirable for the viscosity-altering member 822 to include one or more elongated electrodes.

In FIG. 8, the flow control system 810 further includes an orifice 826 or aperture disposed within a plate 830 or ring centrally positioned within a passage of the ring-shaped viscosity-altering member 822. While the orifice 826 in FIG. 8 is illustrated as being concentrically aligned with the passage of the ring-shaped viscosity-altering member 822, in some embodiments it may be desirable for the alignment of these features to be non-concentric.

The flow control system 810 allows selective control over fluid being able to pass through the orifice 826 and as such controls whether fluid flow occurs between passage 818 and annulus 816. When the viscosity-altering member 822 is actuated, thereby increasing the apparent viscosity of the fluid, fluid flow through the orifice 826 and thus the port 820 is reduced or in some instances stopped. The viscosity-altering member 822 effectively acts a valve that may be re-opened by de-actuating the viscosity-altering member 822 when it is desired to re-establish fluid flow between the passage 818 and the annulus 816. Such a configuration would be useful in circulating valves such as the Internal Pressure-Operated (IPO) Circulating Valve manufactured by Halliburton Energy Services, Inc.

Figure 9:
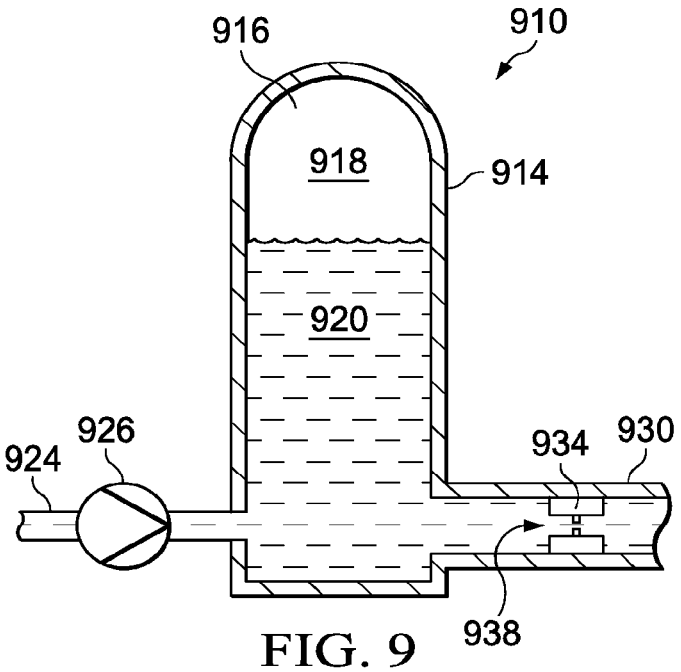
FIG. 9 illustrates a cross-sectional schematic of a flow control system according to an illustrative embodiment, the flow control system having a viscosity-altering member positioned within an outlet line of an accumulator containing a high pressure fluid.

Referring now to FIG. 9, a flow control system 910 according to an illustrative embodiment includes an accumulator 914 having a cavity 916 in which a fluid 920 may be stored. A compressible fluid 918 may also be contained within the accumulator to allow the storage of the fluid 920 at relatively high pressure. An inlet line 924 is provided with a check valve 926 to supply fluid 920 to the accumulator, and an outlet line 930 is also provided. Within the outlet line 930 is positioned a viscosity-altering member 934 and an orifice 938. As described herein, the viscosity-altering member 934 when actuated is capable of increasing the apparent viscosity of the fluid 920 to prevent flow of the fluid 920 through the orifice 938. When the viscosity-altering member 934 is de-actuated, flow through the orifice 938 is again permitted and the flow of the highly-pressured fluid 920 from the accumulator 914 is capable of activating other systems. An example of such a tool is a subsea test tree system such as the Dash™ Emergency Response Module (ERM) manufactured by Halliburton Energy Services, Inc. of Houston, Tex. The use of the viscosity-altering member in a subsea test tree system would include providing a powered wire that actuates the viscosity-altering member and thus traps fluid within an accumulator. If electrical power is every halted, the viscosity-altering member would become de-actuated and would allow fluid to leave the accumulator, thereby activating an emergency unlatch system.

Figure 10:
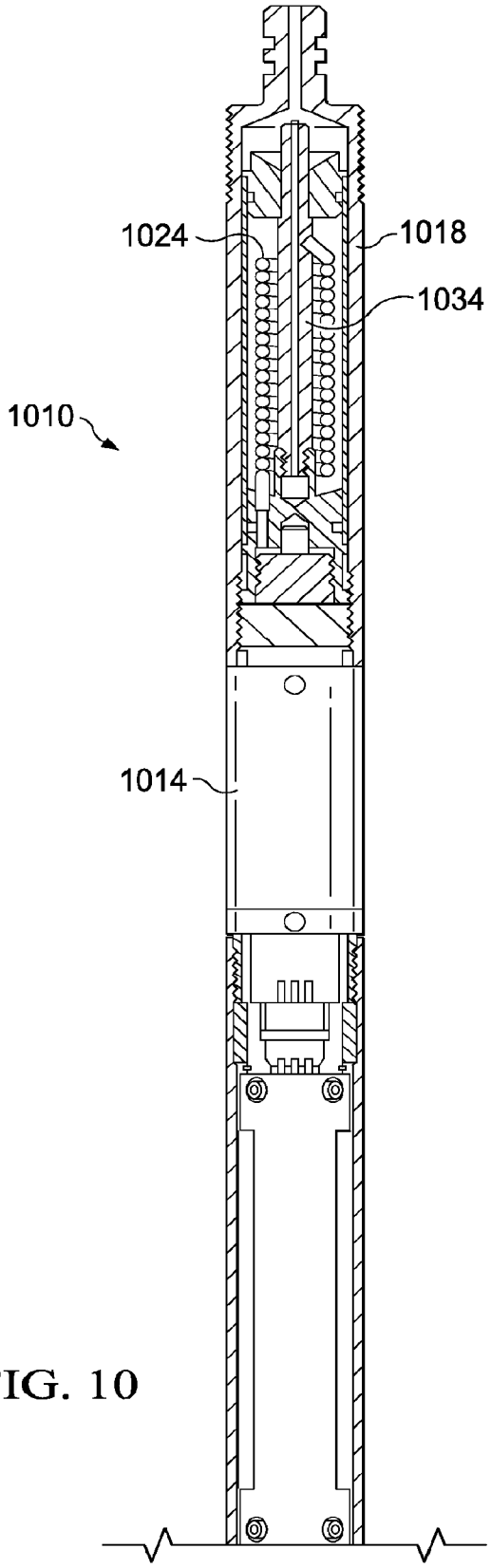
FIG. 10 illustrates a cross-sectional view of a pressure sensing tool according to an illustrative embodiment.

Referring to FIG. 10, a pressure sensing tool 1010 includes a quartz gauge 1014 having a quartz crystal disposed within a tool housing 1018. In downhole applications using quartz gauges, it is desired to not have a diaphragm between the quartz crystal and the fluid pressure being sensed. A metal diaphragm will induce an amount of hysteresis to the gauge performance. A small capillary tube 1024 may be fluidly connected between the quartz crystal and the fluid area in which pressure is being sensed. A problem may occur, however, if the light fluid contained in the capillary tube drains out of the capillary tube 1024 as the pressure sensing tool is transported and delivered in the well. Draining of the fluid may allow corrosive well fluid to occupy the tube, which may ultimately attack the wires associated with the quartz crystal. While a thicker fluid may prevent drainage from the capillary tube during tool delivery, the thicker fluid cannot be used because the thicker fluid would cause errors in the quartz gauge readings. A solution to these issues may be provided by a viscosity-altering member 1034 disposed in the pressure sensing tool 1010. In some embodiments, the viscosity-altering member 1034 may be a shaft disposed in a central passage defined by the coiled capillary tube 1024. Alternatively, a viscosity-altering member such as those previously described herein may be associated with the capillary tube 1024. In any of these embodiments, the viscosity-altering member 1034 may be positioned such that a magnetic, electric, or other field may be directed to an orifice associated with the capillary tube 1024, or the capillary tube 1024 itself (in which case, the length of the tube exposed to the field may be considered the orifice) to alter the viscosity of fluid within or proximate the orifice.

In one particular embodiment, the viscosity altering member 1034 (e.g., the shaft) is magnetized, but is capable of losing magnetic force when exposed to increased temperature. In this embodiment, an MR fluid fills the capillary tube 1024, and at surface-like temperatures (i.e. relatively low temperatures), the magnetic field provided by the viscosity-altering member 1034 increases the apparent viscosity of the MR fluid such that the fluid does not drain from the capillary tube 1024 as the pressure sensing tool 1010 is delivered downhole. As the pressure sensing tool 1010 arrives downhole, where higher temperatures are encountered, the magnetic field provided by the viscosity-altering member 1034 decreases or ceases, and the apparent viscosity of the MR fluid decreases, thereby allowing the thinner fluid to not impede the sensed pressure transmission to the quartz sensor.

The viscosity-altering members and flow control systems described herein may be deployed in any downhole or surface device or application where it is desired to meter or restrict fluid flow. The configurability of the described systems and methods allows quick and simple control of fluid flow within these tools by adjusting the apparent viscosity of the fluid. By varying the amount of electrical field or magnetic field applied by the viscosity-altering member (depending on whether ER fluid or MR fluid is used), the flow of fluid may be increased, decreased, or prevented. Additionally, by linking the adjustability of the viscosity-altering member with the measurement of the fluid temperature, the apparent viscosity of the fluid can be maintained at a constant level despite temperature changes.

It should be apparent from the foregoing that an invention having significant advantages has been provided. While the invention is shown in only a few of its forms, it is not limited to only these embodiments but is susceptible to various changes and modifications without departing from the spirit thereof.

We claim:

1. A downhole tester valve comprising:

a housing defining a central passage, an annular chamber, and first and second ports extending from the annular chamber to an exterior of the housing;

a valve member positioned within the central passage of the housing and selectively positionable in an open position or a closed position to allow or prevent fluid communication through the central passage of the housing;

a liquid chamber extending within the annular chamber axially between the first and second ports, the liquid chamber having a liquid with a selectively-adjustable viscosity, the liquid being capable of directly or indirectly exerting a force on the valve member to move the valve member to at least one of the open position or the closed position;

an orifice associated with the liquid chamber to allow the liquid to enter or exit the liquid chamber; and a viscosity-altering member capable of being activated to change the viscosity of the liquid and thus a rate at which the liquid is able to enter or exit the liquid chamber via the orifice, thereby controlling the direct or indirect exertion of the force by the liquid on the valve member;

wherein the liquid is adapted to directly or indirectly exert the force on the valve member in response to a fluid pressure being communicated, via each of the first and second ports, between the exterior of the housing and the annular chamber.

2. The valve of claim 1 further comprising:

an actuation arm operably associated with the valve member to position the valve member in the open position or the closed position.

3. The valve of claim 2 further comprising:

a gas-filled chamber having a pressurized gas exerting a biasing force on the actuation arm to bias the valve member toward the closed position.

4. The valve of claim 3, wherein the liquid chamber is separated from the gas-filled chamber by a gas-fluid balancing seal, the liquid being capable of exerting an equalizing force on the gas-fluid balancing seal to compress the gas in the gas-filled chamber such that a pressure of the gas in the chamber is approximately equal to a pressure of the liquid in the liquid chamber.

5. The valve of claim 1, wherein the indirect exertion of the force to the valve member is provided by the liquid acting on a gas-fluid balancing seal, the gas-fluid balancing seal acting on a gas-filled region, the gas-filled region acting on a power mandrel, the power mandrel acting on an actuation arm, and the actuation arm acting on the valve member.

6. A method of operating a downhole device the method comprising:

providing the downhole device, the downhole device comprising:

a housing defining a central passage, an annular chamber, and first and second ports extending from the annular chamber to an exterior of the housing;

a passage or cavity extending within the annular chamber axially between the first and second ports, the passage or cavity accommodating a fluid with a selectively-adjustable viscosity; and an orifice in fluid communication with the passage or cavity;

communicating, via each of the first and second ports, a fluid pressure between the exterior of the housing and the annular chamber;

flowing the fluid with the selectively-adjustable viscosity through the orifice of the downhole device, the fluid having a viscosity of a first amount; and selectively changing the viscosity of the fluid to a second amount such that a rate at which the fluid is able to enter or exit the orifice is changed;

wherein the fluid flows through the orifice in response to the fluid pressure being communicated, via each of the first and second ports, between the exterior of the housing and the annular chamber.

7. The method of claim 6, wherein the first amount is less than the second amount.

8. The method of claim 6, wherein selectively changing the viscosity of the fluid further comprises:

applying a magnetic field in proximity to the orifice to change the viscosity of the fluid.

9. The method of claim 6, wherein selectively changing the viscosity of the fluid further comprises:

applying an electric field in proximity to the orifice to change the viscosity of the fluid.

10. The method of claim 6 further comprising: selectively changing the viscosity of the fluid to a third amount.

11. The method of claim 6, wherein the changing of the viscosity of the fluid to the second amount substantially prevents flow of the fluid through the orifice.

12. The method of claim 6, further comprising measuring a temperature of the fluid, wherein the changing of the viscosity of the fluid to the second amount is performed in response to changes in the temperature of the fluid.

13. A downhole apparatus for use in a wellbore, the apparatus comprising:

a housing defining a central passage, an annular chamber, and first and second ports extending from the annular chamber to an exterior of the housing;

a passage or cavity extending within the annular chamber axially between the first and second ports, the passage or cavity accommodating a fluid with a selectively-adjustable viscosity;

an orifice in fluid communication with the passage or cavity; and a viscosity-altering member positioned in proximity to the orifice and capable of being activated to change the viscosity of the fluid and thus a rate at which the fluid is able to pass through the orifice;

wherein the fluid is adapted to pass through the orifice in response to a fluid pressure being communicated, via each of the first and second ports, between the exterior of the housing and the annular chamber.

14. The apparatus of claim 13, wherein the fluid is an magnetorheological fluid.

15. The apparatus of claim 13, wherein the fluid is an electrorheological fluid.

16. The apparatus of claim 13, wherein the housing is a tubing string.

17. The apparatus of claim 13, wherein the orifice is formed within a plate positioned adjacent to or in contact with the viscosity-altering member.

18. The apparatus of claim 13, wherein the viscosity-altering member is a magnetic field source.

19. The apparatus of claim 13, wherein the viscosity-altering member is an electric energy source.

20. The apparatus of claim 13 further comprising:

a second passage or second cavity disposed within the housing;

a second orifice in fluid communication with the second passage or second cavity; and a second viscosity-altering member positioned in proximity to the second orifice and capable of being activated to change the viscosity of the fluid and thus a rate at which the fluid is able to pass through the second orifice.

21. The apparatus of claim 20, wherein the first viscosity-altering member is actuated when the second viscosity-altering member is de-actuated to selectively allow flow of the fluid through the second passage or second cavity but not through the first passage or first cavity.

* * * * *